United States Patent [19]

Goodwin et al.

[11] 4,327,641

[45] May 4, 1982

[54] DUAL-HEAD DUPLICATOR WITH ALTERNATE SIMPLEXING CAPABILITY

[75] Inventors: Eber L. Goodwin, Arlington Heights; Thomas J. Borke, Hoffman Estates; Joel D. Armstrong, Antioch, all of Ill.

[73] Assignee: AM International, Inc., Chicago, Ill.

[21] Appl. No.: 844,417

[22] Filed: Oct. 21, 1977

[51] Int. Cl.[2] ..... B41F 9/00

[52] U.S. Cl. ..... 101/144; 101/184; 101/231

[58] Field of Search ..... 101/90, 91, 144, 145, 101/216, 217, 229-231, 247, 141, 132, 132.5, 137, 139, 140, 143, 182, 184, 218, 351-352

[56] References Cited

U.S. PATENT DOCUMENTS

| | | | |
|---|---|---|---|
| 3,461,798 | 8/1969 | Bulk | 101/184 |
| 3,490,367 | 1/1970 | Kaneko | 101/144 |
| 3,785,287 | 1/1974 | Dahlgren | 101/247 |
| 3,987,722 | 10/1976 | Goodwin | 101/91 |

*Primary Examiner*—Edgar S. Burr
*Assistant Examiner*—A. J. Heinz
*Attorney, Agent, or Firm*—Anthony W. Karambelas; Robert C. Curfiss

[57] ABSTRACT

A tandem dual-head lithographic duplicator is equipped for operation in alternative modes, i.e., either for duplexing by printing on opposite faces of the copy sheets in sequence, or for simplexing. In the simplexing mode the printing of the copy sheets is carried out on one head simultaneously with the cleanup and preparation operations on the other head, with a sequence of printing jobs being performed alternately on one printing head and then on the other while, in each case, the non-printing head is being prepared. Accordingly, substantially continuous simplexing operation can be achieved except in the case of very short printing runs.

6 Claims, 14 Drawing Figures

Fig. 1
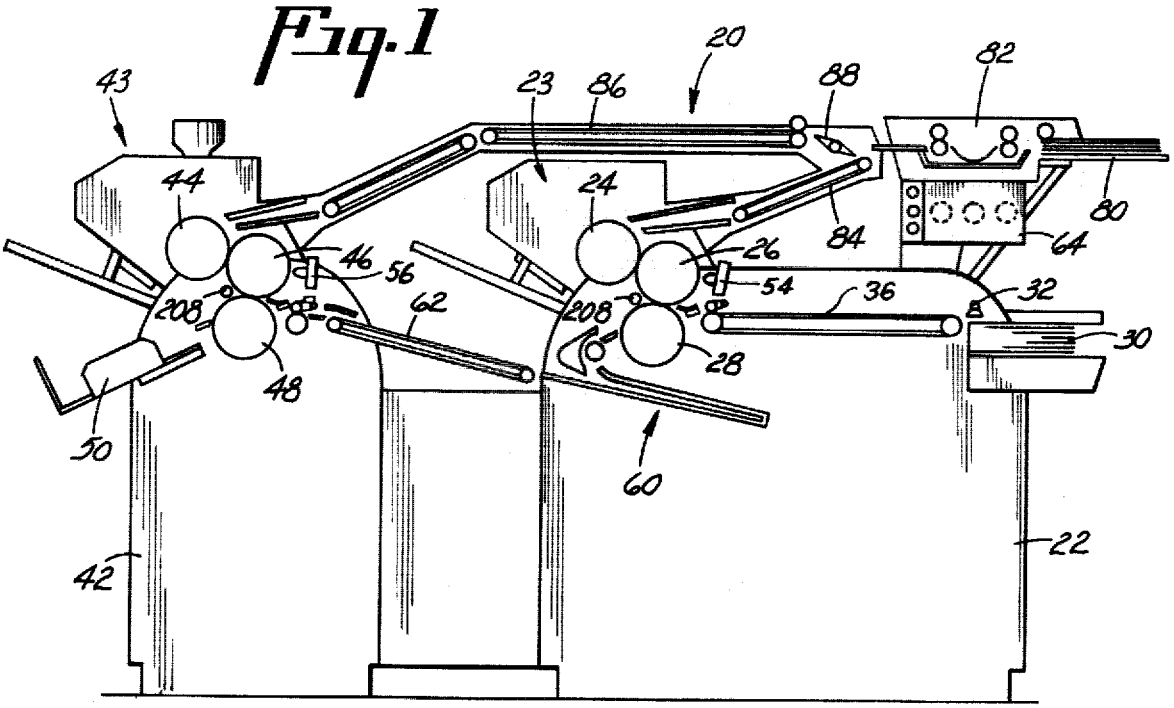
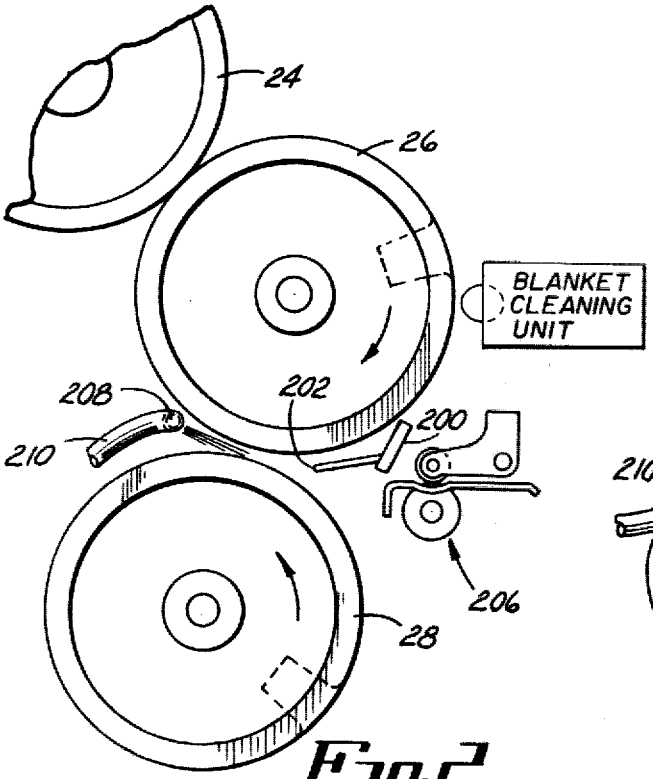
Fig. 2
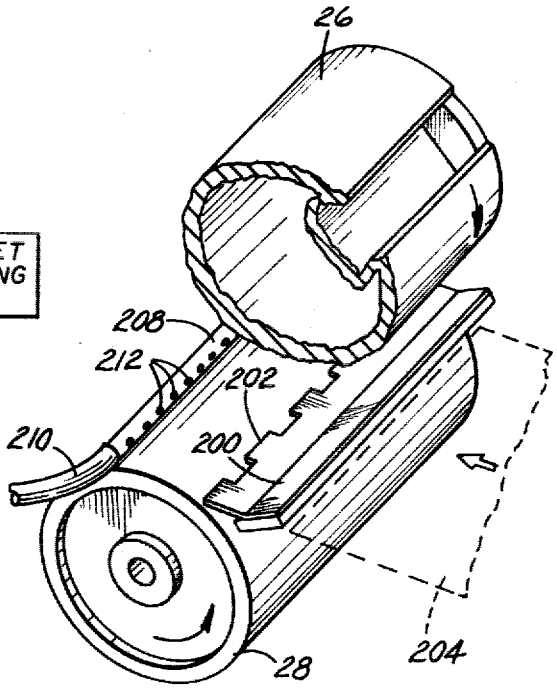
Fig. 3

DUAL-HEAD DUPLICATOR WITH ALTERNATE SIMPLEXING CAPABILITY

BACKGROUND OF THE INVENTION

Lithographic duplicators capable of duplexing, that is printing on both faces of a copy sheet in a single pass, are conventional equipment. These duplicators are normally arranged with tandem print heads between which is disposed a sheet turnover device which may be rendered operative or disabled depending upon whether duplex printing or one-side, two-color printing is desired. Such machines are also capable of operating in a simplexing mode to provide single-face, single impression printing, and in this case the printing is done on one of the print heads while the other print head idles to pass the copy sheet through, the turnover device normally being disabled during this procedure.

In the simplexing mode as just described, the duplicator is essentially operated exactly like a single-head duplicator and requires a cleanup and preparation operation on the printing head in use, each time a printing job is completed and before another can be started. It will be readily appreciated that in equipment of this type the copy sheet must pass through the nip of the printing cylinders on the non-printing head just as if it were being printed, except for the fact that there is no image on the blanket cylinder. For this reason it is the second head of the two which is normally used for printing to avoid offset and tracking problems on the non-printing head.

Recently there has been developed high-speed automated dual-head duplicating equipment, especially applicable in short run systems use, which is arranged to take prepared masters from a single supply source and feed them to the two print heads and automatically install them thereon, and this has very materially speeded up the duplexing operation of such machines and simplified the operator's task. Such a machine is shown in U.S. Pat. No. 3,987,722 to E. L. Goodwin, assigned to the assignee of the present application.

In none of the foregoing prior art arrangements was there provided any way to augment the production of such dual-head duplicators when operating in a simplexing mode.

SUMMARY OF THE INVENTION

It is an object of the present invention to provide dual-head duplicators, and especially those of the type shown in U.S. Pat. No. 3,987,722, so equipped as to be capable of providing simplex printing on either print head, simultaneously with preparation operations on the other print head. This will allow the printing operation of the machine to continue in a substantially uninterrupted manner when single-face printing is desired, to thereby materially improve the output of the machine in the simplex mode.

In order to accomplish the foregoing object, the machine is equipped with a number of novel features including:

1. Means for automatically disabling the cylinder closing mechanism on either head to allow the blanket and impression cylinders of the non-printing head to remain in separated condition, whereby a copy sheet may pass between them without conflicting with the simultaneously effected blanket cleaning operation.

2. Special sheet guiding and deflecting means adjacent the cylinder nip at each head which cause a copy sheet passing between the separated cylinders of the non-printing head to be urged towards the impression cylinder and to be spaced as remotely as possible from the blanket cylinder.

3. A novel gripper mechanism forms a part of the impression cylinder of each head, and is so arranged that the lead margin of the copy sheet is gripped in a position which holds it substantially tangent to the impression cylinder surface, thus avoiding the inducement of any bow in the sheet which might tend to displace a portion of the sheet away from the impression cylinder and towards the blanket cylinder when the sheet is being conveyed between the separated cylinders of the non-printing head.

4. Electrical control circuit means for causing the print heads to alternate in printing operation and in preparation operation in overlapping fashion.

DESCRIPTION OF THE PREFERRED FORM OF THE INVENTION

In the Drawing:

FIG. 1 is a diagrammatic side elevation of a dual-head duplicator according to the present invention;

FIG. 2 is a diagrammatic side elevation to larger scale of one of the print heads of the duplicator of FIG. 1;

FIG. 3 is a perspective view, with portions broken away, showing the blanket cylinder, impression cylinder and auxiliary sheet control features of FIG. 2;

Figure 11A:
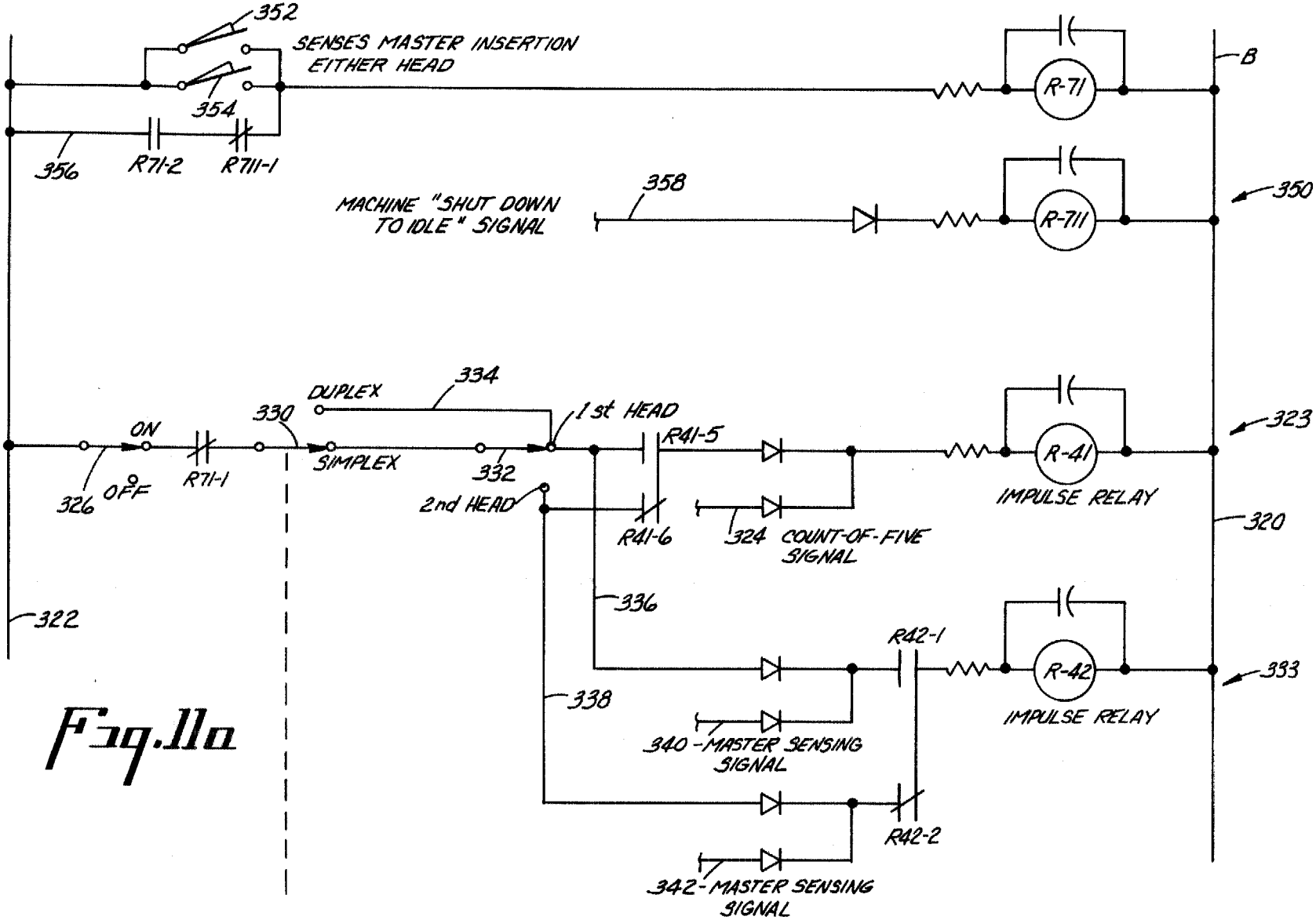
Figure 11B:
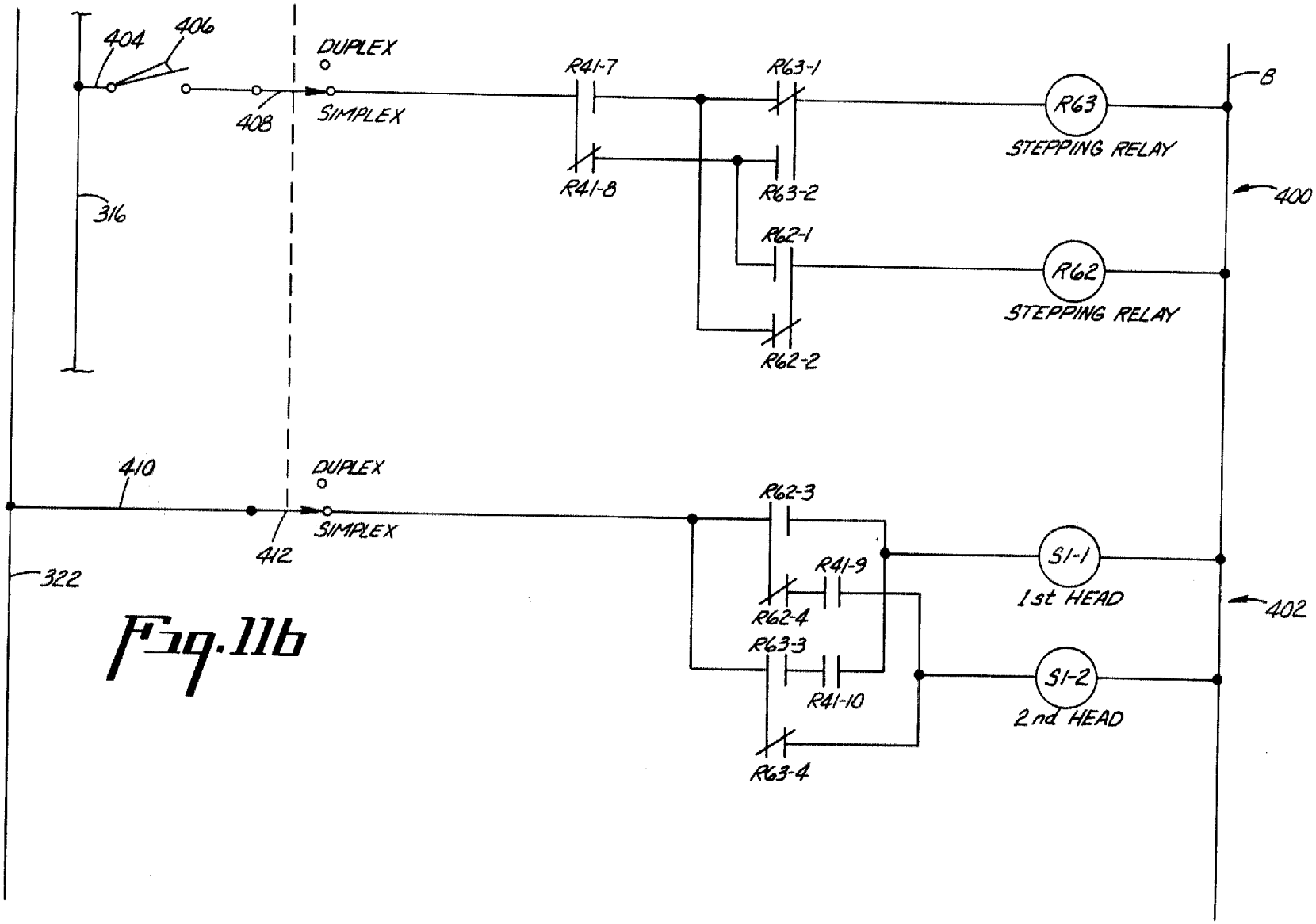
Figure 12:
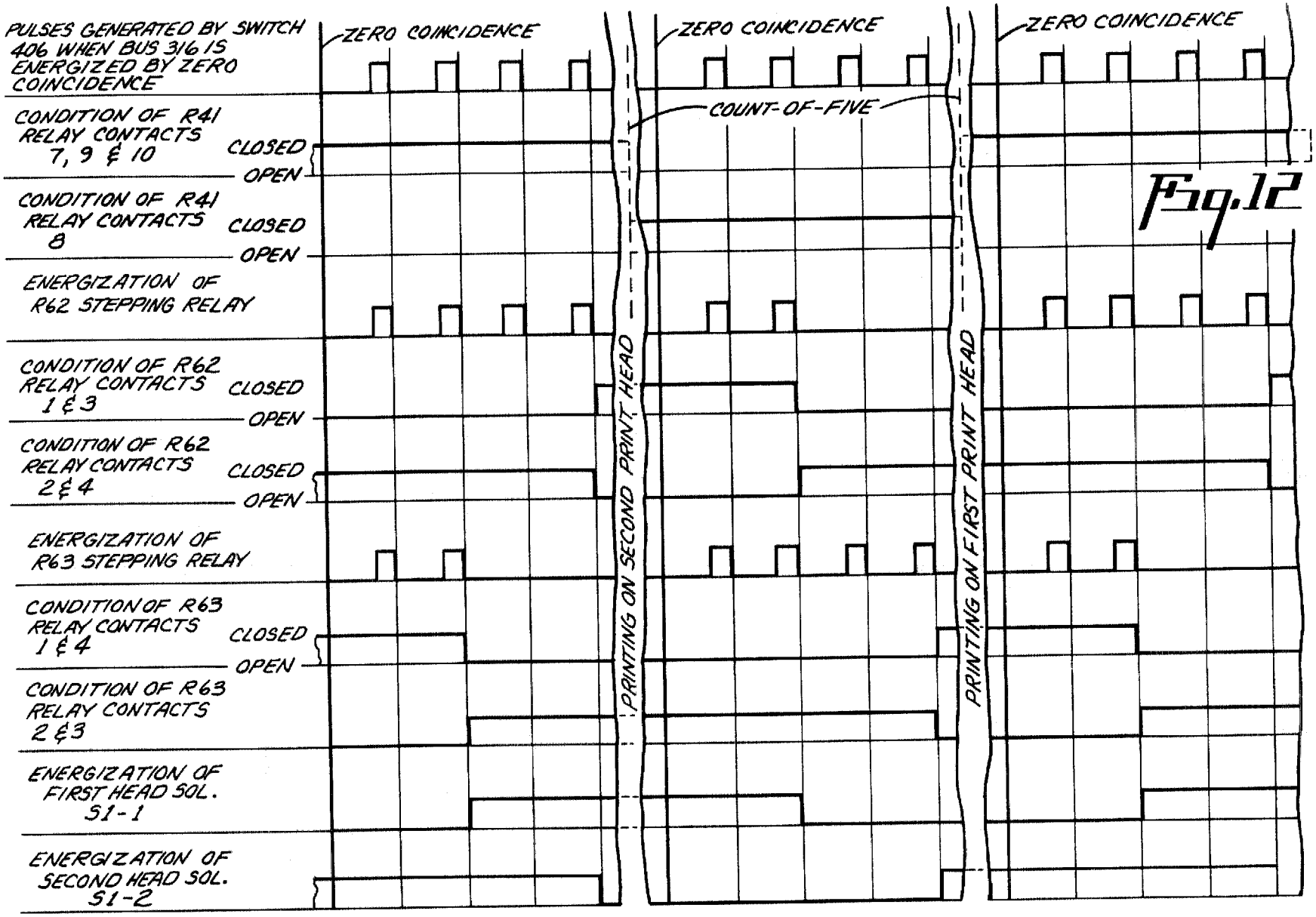
Figure 13:
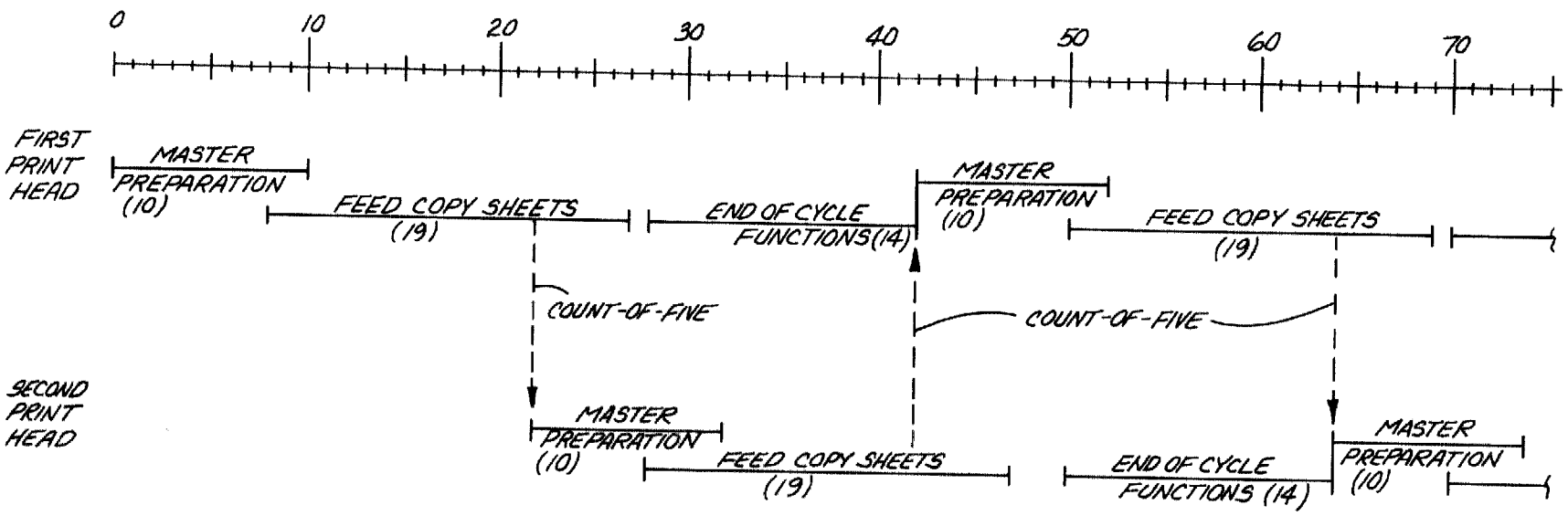

FIG. 11, made up of segments 11*a* and 11*b*, is an electrical schematic illustrating the balance of the control circuitry of a machine according to the invention;

FIG. 12 is a chart illustrating in detail the states of certain portions of the electric circuit of FIG. 11 at various times during machine operation; and FIG. 13 is a timing chart illustrating the operating characteristics of the machine under one particular set of circumstances.

This invention relates to rotary lithographic duplicators having two printing heads as exemplified in FIG. 1 wherein the duplicator as a whole is identified by reference character 20.

The main duplicator frame 22 includes a first print head 23 made up of a master cylinder 24, a blanket cylinder 26 and an impression cylinder 28, the latter two forming between them a printing nip. A supply of copy paper 30 is held in position to cooperate with a vacuum feeder 32 which takes one sheet at a time from the supply and forwards it to a conveyor 36 which presents the sheet to the printing nip provided by the first print head.

The second print head 43 is much like the first, is mounted on a smaller frame 42, and includes a master cylinder 44, a blanket cylinder 46, and an impression cylinder 48. As printed sheets issue from the second printing head they are caught by a receiver 50, or may be otherwise dealt with, as by feeding to a collator.

As each copy sheet issues from the first printing nip 26, 28 it is presented to a turnover mechanism 60 which inverts the sheet and places it on a conveyor 62 which carries it to the second printing head.

For controlling the number of copies to be printed, a conventional presettable copy down counter 64 is provided. Its counting action occurs in response to a sensor detecting each sheet as it is fed from the supply 30.

The dual-head duplicator, as thus far described, is a conventional arrangement which has been in use for many years.

In a preferred form of the invention about to be described, the masters which are used on the print heads 23 and 43 are stored in a single master supply 80 where they can be fed, first through a conversion apparatus 82, and then alternately to print heads 23 and 43 via conveyors 84 and 86 under the control of a gate mechanism 88. The details of this construction are explained at length in U.S. Pat. No. 3,987,722 which may be referred to for specific information on this type of operation, and which is incorporated herein by reference to the extent required.

In normal operation of the conventional dual-head duplicator as thus far described, both print heads 23 and 43 are provided with masters and print on each copy sheet as it passes through the machine. This may be in the form of an impression first on one face and then on the other, or, if the turnover device 60 is disabled, two impressions on the same side of the sheet. Thus both print heads would be printing during the printing cycle, and both print heads would be idle during the cleanup and master changing cycle.

Blanket cleaning units 54 and 56 are respectively located adjacent to the blanket cylinders 26 and 46 to respectively perform blanket cleaning operations on the blanket cylinder 26 of the first print head 23 and the blanket cylinder 46 of the second print head 43. Blanket cleaning units, such as the units 54 and 56, are well known in the art and may be, for example, of the type disclosed in U.S. Pat. No. 3,693,547, assigned to the assignee of the present invention.

According to the present invention the operation of the system can be changed so that only one head prints at a time, the other head being cleaned and having its master replaced while the one head is printing, with the situation alternating for each print cycle.

In order to do this the control system has been revised so that even though the machine is performing a printing operation, the cylinders of the non-printing head may be held in separated condition to allow copy sheets to pass between them.

Figure 6:
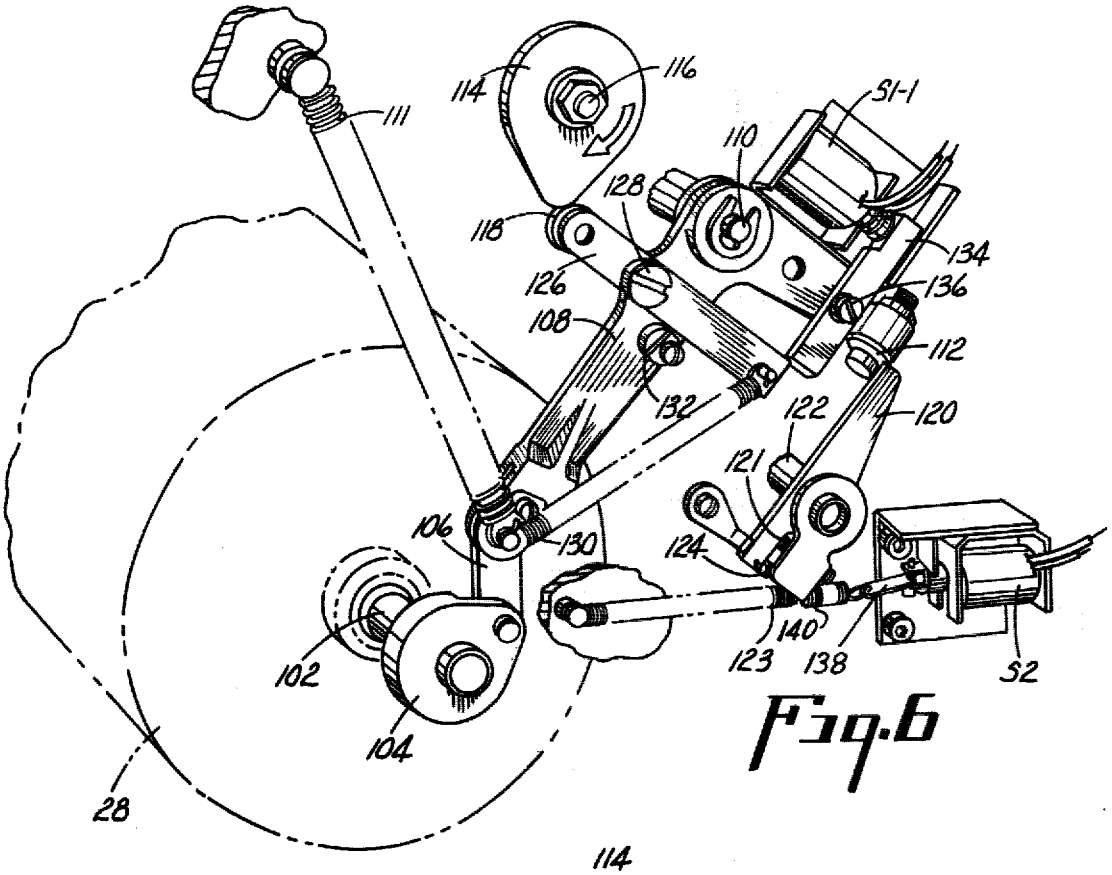
FIG. 6 is a perspective view of the cylinder separation mechanism for raising and lowering the impression cylinder, the parts being shown in the normal printing condition.
Figure 7:
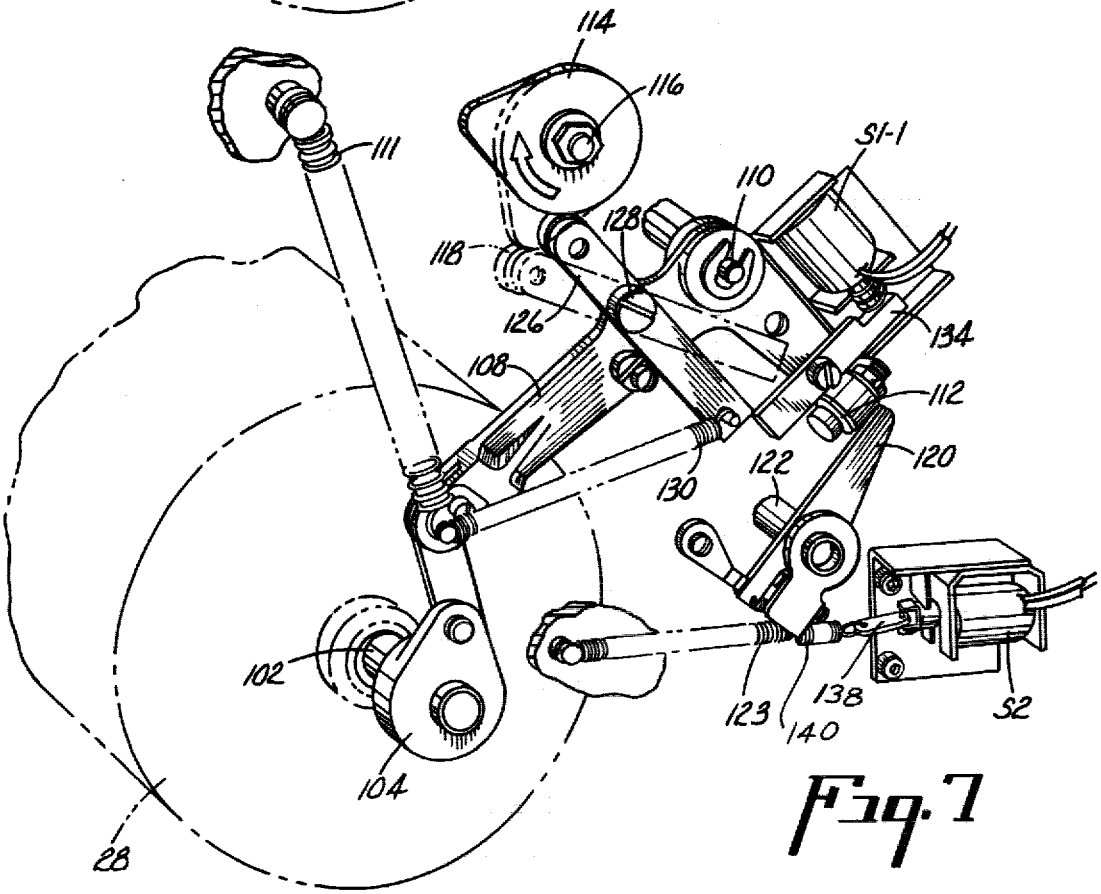
FIG. 7 is a view similar to FIG. 6 but showing the parts in the non-printing condition.

FIGS. 6 and 7 illustrate the nature of this construction. In these views, the cylinder shown in phantom is the impression cylinder 28 on the first print head 23.

It will be understood, however, that the construction about to be described appears on both print heads.

The position of the cylinder is controlled by an eccentric shaft 102 which is shown in the cylinder contact position in FIG. 6. The shaft position is controlled by a crank arm 104 drivingly connected thereto. The crank is connected to one end of a link 106, the other end of which is connected to a cylinder separating lever 108 pivotally mounted on the frame as at 110 and carrying at its remote end a member providing a latching surface 112. A tension spring 111 connected to the pivot joining the crank 104 and lever 108 tends to move the shaft 102 in a cylinder separating direction. Actuation of the lever in the other direction is brought about by a cylinder separation cam 114 driven at the rate of one rotation per machine cycle by a shaft 116. The cam 114 cooperates with a follower roller 118 which, for the moment, may be considered as carried by a rigid extension of the lever 108, so that once every machine cycle the lobe of cam 114 moves or nudges the lever 108 to a position wherein the cylinders would be in printing contact, except that this occurs at the time when the cylinder gaps are opposed.

The lever 108 is subject to being latched in cylinder engaged position by a latch member 120 operated by a shaft 122 acting through set screw 121 and a tension spring 124. A tension spring 123 tends to turn the shaft 122 and the latch 120 in a clockwise or unlatching direction. As shown in FIG. 6, the latch member 120 is holding the lever 108 in such position that the cylinders are engaged for printing, and this is the normal condition during a printing operation. The shaft 122 has in the past been mechanically connected with a sensing finger (not shown) at a ready position just ahead of the printing nip, and whenever a copy sheet is present at this location, the latch 120 is moved into the position shown in FIG. 6 in opposition to the spring 123. This happens when the surface 112 is fully retracted by the cam action, and as soon as the cam releases, surface 112 rests against the latch and binds it against release for the balance of the cycle. The cylinders consequently stay in contact for printing. If a sheet should fail to feed properly, however, so that a sheet is not presented at the ready position on time to be sensed, a different condition would exist. The sensing mechanism will then fail to load the shaft 122 in a latching direction. Then whenever the cam 114 nudges the follower 118 it moves the lever 108 very slightly so that pressure on the surface 112 exerted by reason of spring 111 is released and the latch 120 is withdrawn by spring 123 to the FIG. 7 position, allowing the spring 111 to separate the cylinders to prevent an imprint being made on the surface of the impression cylinder.

The construction just described is entirely conventional and is identical for both printing heads.

According to the present invention means are provided for overriding the operation just described to allow a selected print head to remain in cylinder separation condition continuously even though copy sheets are being sensed regularly at the ready position for that head, and even though the cam 114 is continually seeking to bring the cylinders together each revolution. While the following description and FIGS. 6 and 7 refer specifically to the first print head 23, this in the interest of brevity, and it will be realized that both print heads are similarly equipped.

To this end the conventional rigid connection of the follower roller 118 to the lever 108 is done away with, and instead the follower roller 118 is mounted on an auxiliary lever 126 pivoted to the lever 108 at 128. A tension spring 130 holds the auxiliary lever 126 in normal position against a stop 132 on the lever 108, and the auxiliary lever is locked in this position by a dog 134 pivoted at 136 to the lever 108. The dog 134 can be withdrawn from locking position by energization of a solenoid S1-1 (the solenoid for the second heads being identified as S1-2), but so long as the solenoid remains deenergized, the auxiliary lever acts as a rigid extension of the lever 108.

In addition, to provide for sensing the sheets without mechanical contact (since the sheets at one head will already have an ink impression) a photoelectric sensor (not shown) is substituted for the previously described finger, and the counterclockwise driving of shaft 122 by sheet presence is brought about by a solenoid S2 acting through a link 138 and spring 140, the latter being rather stiff and capable of readily overpowering spring 123. Thus when a paper present signal is generated by the photoelectric sensor the solenoid S2 is energized and tries to rotate the latch 120 counterclockwise in the same manner as occurred in the previously described mechanical sensing arrangement.

With the modified arrangement just described it is now possible to shift either print head from a normal printing operation condition to a condition in which the cylinders are separated and stay separated for the duration of a printing run.

If, for example, the first print head 23 is the one to remain in separated condition because printing is occurring on print head 43, the solenoid S1-1 is energized to withdraw the dog 134 and unlock the auxiliary lever 126. As presently visualized the system is so set up that there will always be at least one cylinder revolution when no copy sheet appears after printing is complete and immediately preceding energization of solenoid S1-1, so that the sheet absent signal will deenergize solenoid S2 and thus cause the latch 120 to drop out when the cam 114 nudges the lever 108. Subsequently the solenoid S1-1 is energized and unlocks the auxiliary lever 126. As seen in FIG. 7, revolution of the cam 114 will now merely brush the follower 118 and auxiliary lever 126 aside as seen in phantom in FIG. 7, and fail to effect the lever 108. Thus the impression cylinder 28 will remain in lowered or separated position for the duration of the printing run due to the action of spring 111.

In order for the copy sheets to pass through the narrow gap between the separated blanket and impression cylinders on the non-printing head, and for them to do so without being in danger of defacement by the blanket cleaning process in progress, special sheet control devices are provided. These are shown in FIGS. 2, 3, 4 and 5 with the first printing head 23 being used as an example, it being understood that both heads are similarly equipped.

In FIGS. 2 and 3 there can be seen the blanket cylinder 26 and the impression cylinder 28 separated therefrom. Mounted on the machine side plates and having a serrated projecting edge 202 is a guide plate 200. The edge 202 extends in close to the location of the nip formed between the cylinders when the cylinders are closed, the guide plate being mounted at that side of the cylinders from which a copy sheet 204 approaches. After the lead margin of the sheet has been grasped by the gripper mechanism (shown in FIGS. 4 and 5) the guide plate 200 serves to keep the remainder of the sheet in a well defined channel which would prevent contact with the blanket cylinder 26 even though the trailing portion may tend to flop slightly after its release by the nip of a conventional feed roller pair 206 which is used to power the initial advance of the sheet between the cylinders.

More specifically, as shown in FIG. 2 and particularly in FIG. 3, the guide plate 200 is so angled toward the surface of the impression cylinder 28 that it causes each approaching copy sheet, whose front or lead margin is being gripped or held by the gripper mechanism as the copy sheet passes between the separated cylinders 26 and 28, to be urged toward the impression cylinder 28 and to be spaced as remotely as possible from the blanket cylinder 26.

After the lead margin of the sheet passes through the area which would form the nip if the cylinders were engaged, it is released by the impression cylinder gripper and comes under the influence of an air manifold 208 served by air pressure through a hose 210 from a suitable air pressure supply (not shown). The manifold is provided with a row of apertures 212 which provide a row of air jets directed against the upper surface of the sheet, and which serve to maintain it in contact with the surface of the impression cylinder until it has moved to a point such that contact with the blanket is no longer a danger. The sheets are moved away from each printing head by conventional ejector wheels (not shown).

Figure 4:
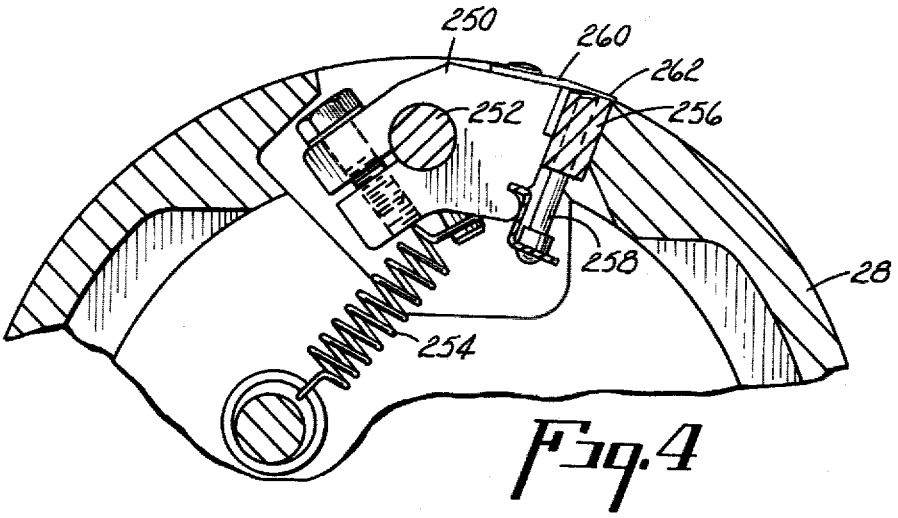
FIG. 4 is a cross section of a portion of an impression cylinder showing the improved gripper mechanism.
Figure 5:
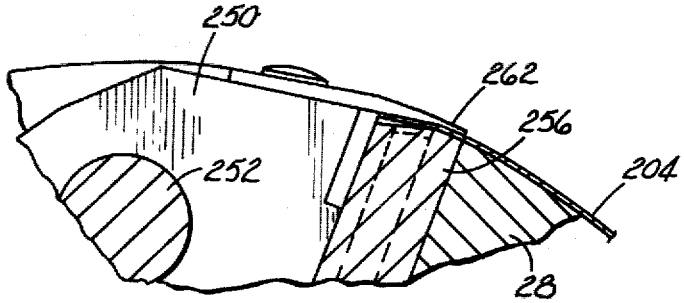
FIG. 5 is a detail section to a larger scale of the device of FIG. 4.

FIGS. 4 and 5 show the above-mentioned gripper mechanism as constructed in accordance with the present invention. The construction is largely conventional in that the impression cylinder 28 carries a gripper 250 attached to a rockable shaft 252 which is activated by a conventional follower and cam (not shown). The spring 254 tends to hold the gripper with its jaw 260 closed against an anvil 256. The grippers also drive ejector pins 258 when the grippers are opened wide to release a sheet to a conventional stripper arrangement (not shown).

Previous gripper arrangements normally have had the entire gripper action buried within the cylinder gap with the plane at which the gripper jaw surface and anvil meet, forming a chordal plane of the cylinder. This arrangement resulted in a tendency for the sheet just behind the gripper, (depending upon the degree of stiffness of the sheet) to bulge slightly away from the surface of the impression cylinder. Such a bulge would normally be immaterial in a case where the sheet is proceeding immediately through a printing nip where it will be squeezed against the impression cylinder during printing, but tends to be detrimental in the present case where avoidance of contact between the sheet and the blanket cylinder is important.

According to the present invention the gripper jaw 260 is so formed that its extreme lip portion 262 is very thin and projects just barely above the surface of the cylinder. The surface of the anvil 256 is also of a different and matching configuration. The meeting plane between the two, where the gripping action upon the sheet margin actually takes place is made tangential to the cylindrical outer surface of the impression cylinder so that the sheet 204 projects smoothly away from the closed gripping action of the gripper jaw and anvil, and tends to lie snugly against the cylinder surface as shown in FIG. 5 so as to greatly reduce the possibility that a copy sheet, passing through the gap between the cylinders of the non-printing head, will be in danger of coming into contact with the blanket cylinder.

CONTROL CIRCUITS

Figure 8:
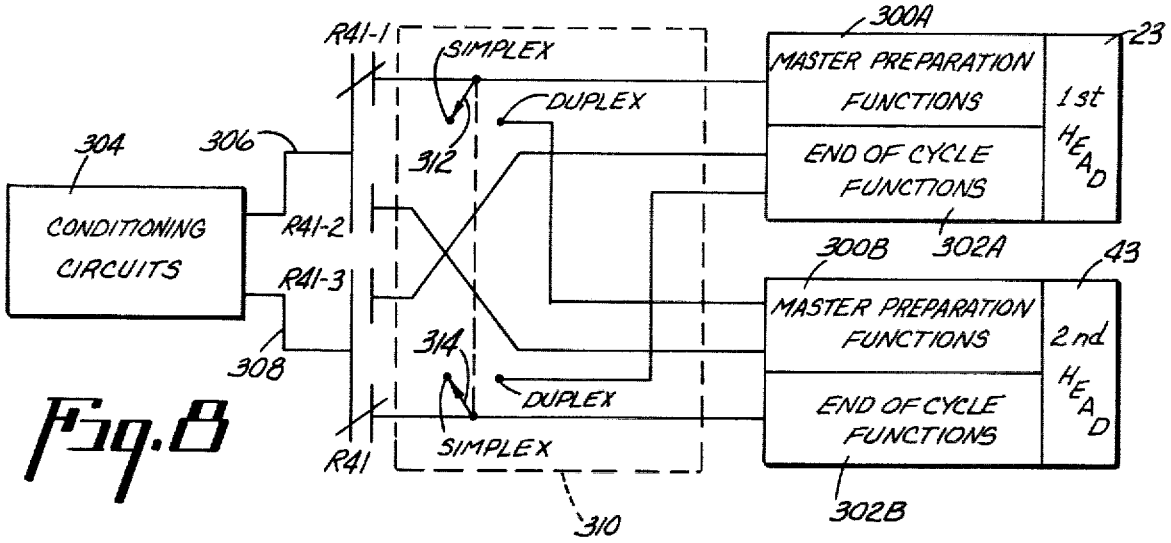
FIG. 8 is an electrical schematic, partially in block form, illustrating a primary aspect of the control circuitry of a duplicator according to the invention, shown in a first state of a simplex mode of operation.
Figure 9:
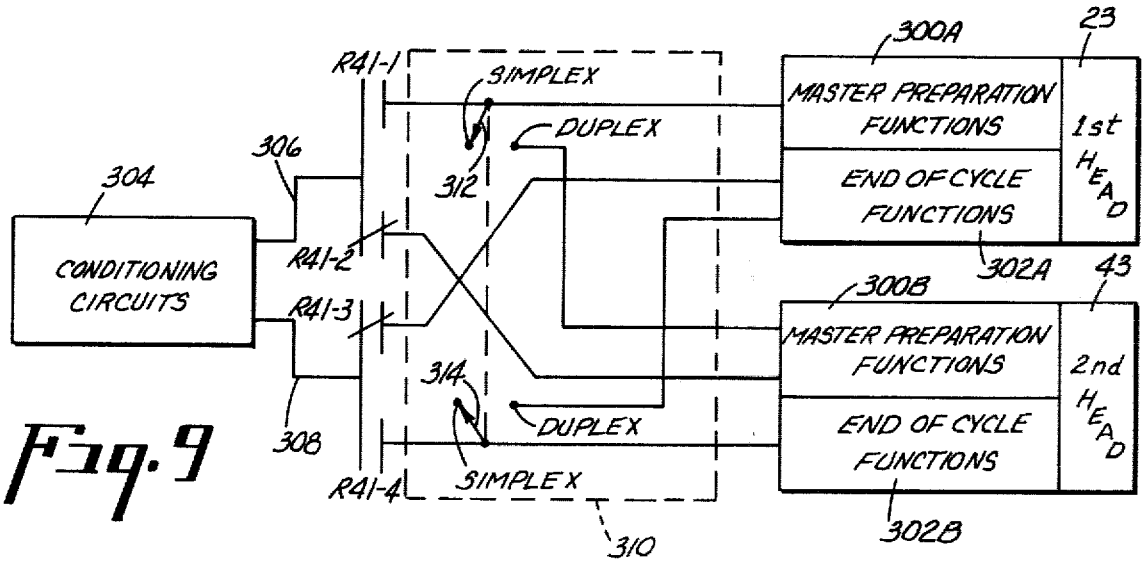
FIG. 9 shows the circuit of FIG. 8, but in a second state.
Figure 10:
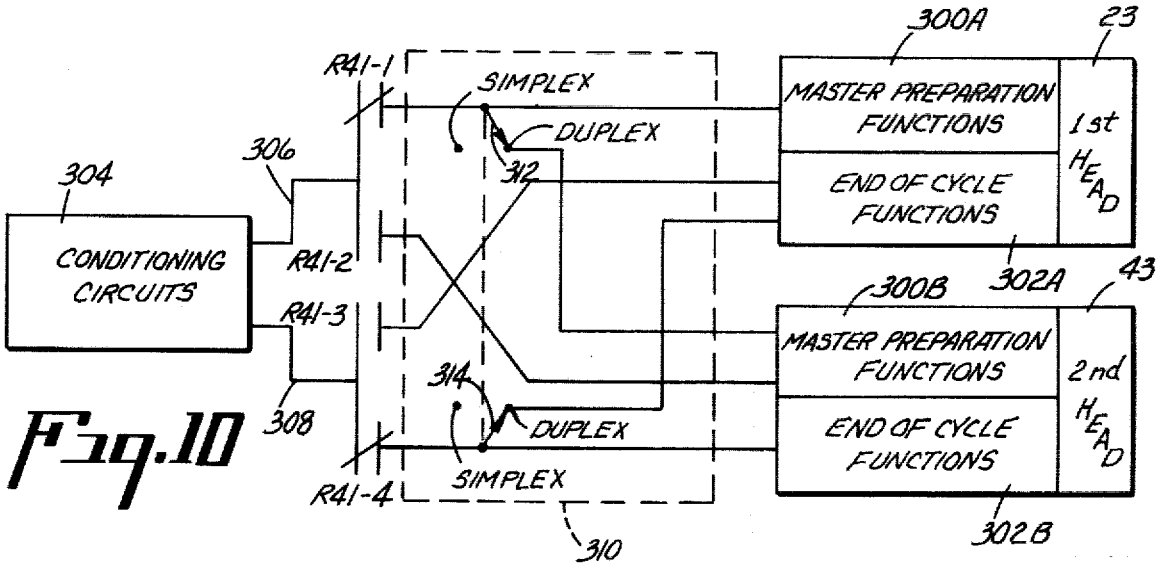
FIG. 10 shows the circuit of FIG. 8 when the machine is operating in a duplex mode.

FIGS. 8, 9 and 10 represent one form of control circuit which can be added to the conventional machine controls for a tandem duplicator to provide for selective operation, either the usual duplex mode or in a simplex mode where the printing operation on one head overlaps the preparation of the other head for sequential printing operations. For convenience the preparation operation is divided into two portions which will be termed "end-of-cycle functions" (such as stopping of the paper feed, master ejection and blanket cleaning) and "master preparation functions" (such as blanket drying, master insertion, master inking and moistening, blanket imaging and starting of paper feed).

FIGS. 8 and 9 show the two possible conditions of the control circuit just mentioned, when the operator has set the controls to a position for continuous alternate simplexing, and the circuit will first be described with respect to FIG. 8.

In the right-hand portion of the Figure are shown block representations of the first print head 23 and the second print head 43 with auxiliary blocks for the conventional circuitry for activating the master preparation functions and end-of-cycle functions of each head, designated respectively as 300A and 302A for the first head, and 300B and 302B for the second. Conventional conditioning circuits designated 304 keep track of the status of printing operations, are provided with two output conductors 306 and 308. During simplexing, the conductor 306 carries a master preparation signal whenever a special counter (not shown) dedicated for the purpose reaches a count value specifically related to the end of the printing run in progress, for example, when the counter reaches a "count of five". The conductor 308 carries a signal whenever the conventional presettable copy down counter counts 64 down to zero coincidence ending the current printing run. The "count of five" condition mentioned above with respect to conductor 306 merely means that a signal is generated when there has been a count of five cylinder revolutions on the special counter since the conventional copy down counter last read ten (or in the case where a very small number of copies under ten was originally set, there have been five revolutions since the commencement of the copy count down. The number five in "count-of-five" is exemplary of course, and depends on various other parameters in the machine operation.

It will be understood that the conventional automated duplicator is provided with a presettable down counter for copies, designated 64 in FIG. 1, and that the circuits are so set up that the machine will proceed automatically from the master preparation functions to copy production providing this copy counter has been set for a desired number of copies, and that it is this counter which is the basis for triggering the operation of the "count-of-five" counter described above.

One of the key controlling features of the operation is a relay R 41, the coil not being shown in this view, but appearing in FIG. 11, which will be presently described. Two alternately conducting sets of contacts R 41-1 and R 41-2 of this relay have their common contact connected to conductor 306. Similarly two other alternately conducting sets of contacts R 41-3 and R 41-4 of the same relay have their common contact connected to conductor 308.

The balance of the circuit is made up of the network indicated as 310 in FIG. 8, and includes simultaneously actuable simplex/duplex selector switches 312 and 314. In FIG. 8 these are shown as being set on the simplex contacts.

Relay R 41 is actually an impulse or "flip-flop" relay and is only momentarily energized to transfer its contacts from one position to the other. For convenience one of these positions is considered a "normal" or "reference" state which obtains just after the machine is in condition for starting to prepare for printing copies on the first print head 23, and the other a "complementary" state which obtains when the machine is in condition for starting to prepare for printing copies on the second print head 43. The reference state is also the condition of relay R 41 which accommodates the duplex operation of the machine.

As can be seen from FIG. 8, a master preparation signal on conductor 306 will activate the master preparation functions on the first head via contacts R 41-1 and network 310. When an end-of-cycle signal is received on conductor 308, it will act via contacts R 41-4 and network 310 to activate the end-of-cycle functions on the second head.

FIG. 9 shows the circuit of FIG. 8, but after R 41 has been toggled and the R 41 contacts have been transferred. In this condition the master preparation signal will activate the master preparation functions on the second head via contacts R 41-2 and network 310, and an end-of-cycle signal on conductor 308 will activate the end-of-cycle functions on the first head via contacts R 41-3 and network 310.

From the foregoing outline of the operation it can be seen that, so long as a copy count is set into the counter before each run, R 41 will continue to toggle and the machine will automatically print copies first on one head and then on the other.

FIG. 10 shows the condition of the circuit when the simplex/duplex switches are thrown so as to rest upon the duplex contacts in preparation for a duplexing operation. It should first be noted that under these circumstances the R 41 contacts will rest in the reference position without change throughout the machine operation, since the R 41 coil will not be toggled when the machine is set up for duplexing. It is apparent that under these circumstances the master preparation signal on conductor 306 will initiate master preparation functions on both heads via contacts R 41-1 and the duplex contact of the simplex/duplex switch, while the end-of-cycle signal on conductor 308 will initiate end-of-cycle functions on both heads via contacts R 41-4 and the duplex contact of the other simplex/duplex switch. Note should also be taken of the fact that the character of the end-of-cycle signal under duplexing conditions is altered. When the control is shifted to duplexing operation the circuitry is shifted by conventional switching means, not shown, to substitute for the "count of five" signal employed during simplexing, a suitable signal generated at termination of the end-of-cycle functions (e.g., the usual energization of means for terminating blanket cleaning).

Turning now to FIG. 11 made up of segments 11A and 11B, the general control circuit is shown in the form of a ladder diagram. A portion of the circuit is powered by the supply bus 316 and ground bus 320, while the remainder is powered by the supply bus 322 and the ground 320. Signals are also supplied at various times on certain alternate power inputs as well, and these will be individually discussed hereinafter.

The supply bus 316 is energized only at particular times, namely from the time the machine is started up until the first master is inserted on the master cylinder of one of the print heads. Thereafter this conductor is energized only for a period starting when the conventional down counter is satisfied (i.e., at zero coincidence) and lasting until the end-of-cycle functions are complete (e.g., blanket cleaning is terminated).

The supply bus 322, on the other hand, has power whenever the machine is turned on.

Perhaps the principle circuit appearing in FIG. 11 is the circuit 323 controlling the operation of relay R 41, discussed above in connection with FIGS. 8 to 10. The relay coil is energized by alternate sources, one, the primary input, is the signal on a conductor 324 which is the count-of-five signal heretofore discussed in connection with conductor 306 in FIG. 8. The other source is from bus 322 via a manual on/off switch 326, contacts R 71-1 of a relay R 71 which will be presently described, and which serve as start-up contacts, and a simplex/duplex selection switch 330. When the switch 330 is on the simplex contact it defines a circuit through a first-head/second-head selection switch 332 by which the operator can make a choice as to which print head should be the first to print copies. The first and second head contacts define alternate current paths to the coil of relay R 41, which paths each include a set of contacts associated with the relay R 41 itself. The path from the first head contact includes contacts R 41-5 which are open when R 41 is in reference position, and the path from the second head contact includes contacts R 41-6 which are closed when R 41 is in reference position.

When the switch 330 is placed on the duplex contact it sets up a path via conductor 334 which bypasses the first-head/second-head selector switch and goes directly to the first head contact.

An auxiliary circuit 333 is provided for controlling a relay R 42 which operates contacts (not shown) governing the operation of a solenoid (not shown) which acts in a previously known manner to switch the gate 88 (FIG. 1) between a position guiding an incoming master to the first print head and a position guiding the master to the second print head. As was the case with the relay R 41, relay R 42 is also an impluse relay, and receives energization via alternate paths from the first and second head contacts of switch 332. That is to say, conductor 336 leads from the first head contact to the coil of relay R 42 via a set of R 42 contacts R 42-1 which are open when the relay R 42 is in reference position (i.e., set to cause the gate 88 to lead a master to the second print head). Conductor 338 leads from the second head contact to the coil of relay R 42 via a set of R 42 contacts R 42-2 which are closed when relay R 42 is in reference position. There is an alternate input conductor 340 in parallel with conductor 336, and this provides one of two primary signals to relay R 42. Conductor 342 is the source of the other primary signal and is in parallel with conductor 338. The signals on conductors 340 and 342 are provided by other circuits, not shown, whenever a master is sensed at the ready station for insertion on the first print head or the second print head respectively.

Control of the contacts R 71-1, mentioned above, is through another auxiliary circuit identified by numeral 350. As can be seen, sensing switches 352 and 354 at the two print heads detect when master insertion occurs at either head and then one or the other closes the circuit through the coil of relay R 71. A holding circuit is formed by conductor 356 which bypasses the switches 352 and 354, and includes holding contacts R 71-2 of relay R 71, and normally closed contacts R 711-1 of a relay R 711. The latter relay is energized by an input pulse on conductor 358 whenever the machine finishes printing and shuts down to an idling condition. It is thus apparent that when R 71 is energized by the first master insertion, the holding contacts R 71-2 are energized at the same time that start-up contacts R 71-1 are opened. This condition is maintained by the holding contacts throughout the printing period of the machine until shutdown to idle occurs. Then the holding circuit is broken by the momentary opening of contacts R 711-1 deenergizing the coil of relay R 71 and allowing contacts R 71-1 to close in order to be ready for the next printing operation. Therefore the start-up contacts R 71-1 remain closed only long enough for the energization to determine the condition of R 41 which agrees with the operator's selection by means of switch 332 as to which head is to simplex first or, if in the duplex mode, to restore R 41 to reference condition ready for duplex printing. If the machine is being operated in the simplex mode, switch 326 may be opened to defeat this start-up effect of contacts R 71-1, assuming that is is immaterial which head prints first. Once contacts R 71-1 are open, and after the first master is inserted on either head, printing continues first on one head and then on the other in response to the control exercized by the signals appearing on conductors 324, 340 and 342 cooperating with the conventional copy down counter.

As previously explained in connection with FIGS. 6 and 7, the immediate controls which determine which printing head is to be the one not printing during any particular simplex printing run are the solenoids S1-1 and S1-2. The circuits which control these solenoids are indicated by reference characters 400 and 402 in FIG. 11, specifically FIG. 11B.

In circuit 400 the main active elements are two stepping relays R 63 and R 62 which serve to count machine cycles (i.e., cylinder revolutions). Each relay is arranged to operate its contacts on alternate counts of two and four revolutions, or alternate counts of four and two revolutions. As seen in FIG. 11, circuit 400, a conductor 404 leads from bus 316 to count switch 406 which is mechanically pulsed once each revolution, then to a simplex/duplex selector switch 408 to two complementary sets of contacts of the R 41 relay, R 41-7 and R 41-8. Two complementary contacts of the R 63 relay are so arranged as to have the contact set R 63-1 connected with R 41-7, and R 63-2 with R 41-8. The common contact of R 63-1, R 63-2 is connected with the coil of the stepping relay R 63. In a parallel arrangement, a pair of complementary contact sets R 62-1 and R 62-2 are also connected with the R 41-7 and R 41-8 contacts respectively, and the common contact of R 62-1, R 62-2 is connected to the coil of the stepping relay R 62. In circuit 402 a conductor 410 leads from bus 322 via a simplex/duplex selector switch 412 which is connected with the common contact of a complementary set of contacts of the relay R 62, namely R 62-3 and R 62-4, and also with the common contact of a complementary set of contacts of the relay R 63, namely R 63-3 and R 63-4. Contacts R 62-3 and R 63-3 are jointly connected to the solenoid S1-1 of the first print head, R 63-3 being in series with contacts R 41-10 of relay R 41. Also contacts 62-4 and 63-4 are jointly connected to solenoid S1-2 of the second print head, R 62-4 being in series with contacts R 41-9 of relay R 41.

The function of circuits 400 and 402 is primarily to effect precise timing of the starting and stopping of printing on the alternately operating print heads in relation to the starting and stopping of the feeding of paper from the paper supply station by feeder 32 at which point the copy count is sensed. It is apparent that some delay exists between feeding a sheet and printing the same sheet at the first print head 23, and a different delay period occurs between feeding a sheet and printing upon the same sheet at the second print head 43. In the present example the first head delay is two cylinder rotations and the second head delay is four cylinder rotations.

By inspection of circuits 400 and 402 it is apparent that when relay R 41 is in the reference position (during printing on the first head) circuit 400 will be idle inasmuch as bus 316 is not energized. In circuit 402, open contacts R 62-3 and R 63-3 will block energization of solenoid S1-1, and closed contacts R 63-4 will cause energization of solenoid S1-2 on the second head to maintain the cylinders in separated position.

When the count-of-five signal is received on conductor 324 relay R 41 is toggled causing transfer of contacts R 41-7 and R 41-8 as well as R 41-9 and R 41-10. This causes no immediate effect in circuit 400 since bus 316 is not yet energized, and in circuit 402 the solenoid energization is not affected by the closing of R 41-9 and R 41-10. As soon as the counter counts out to zero coincidence, bus 316 is energized and a conductive path to the relays R 63 and R 62 starts their stepping action. When switch 406 has sent two pulses to R 63, its four sets of contacts transfer, stopping the pulses to R 63 and transferring energization from solenoid S1-2 to solenoid S1-1 on the first head so as to separate the first head cylinders. Meanwhile R 62 is being stepped and when, two pulses later, it receives its fourth pulse, its four sets of contacts transfer. This terminates stepping of R 62 and removes energization from solenoid S1-2 to allow closing of the nip at the second print head whenever paper is sensed.

Printing then proceeds in due course on the second print head until the count-of-five signal again appears on conductor 324, toggling the relay R 41 once more. The effect of this (once the conductor 316 is again energized by count out) is to transfer contacts R 41-7, R 41-8, R 41-9 and R 41-10 back to reference position which initiates stepping of both relays R 63 and R 62. When relay R 62 has received two pulses from switch 406, its four contact sets transfer stopping the stepping action of R 62 and deenergizing the first head solenoid to allow closing of the nip whenever copy paper is again sensed. Meanwhile R 63 is being stepped also and when two pulses later it accomplishes the fourth pulse, its four sets of contacts transfer which stops the stepping of relay 63 and restores the circuit to reference condition with the solenoid S1-2 energized so as to cause separation of the cylinders to prevent printing on the second head.

Due to the complexity of relay action, it is thought that the position of the various contacts in circuits 400 and 402 at different stages in the operation may be more readily visualized by means of a status table relating contact position to number of revolutions, and this information is accordingly presented in FIG. 12 for ready reference. In any case it is apparent that the function of the circuits 400 and 402 just described allows the final copy sheet of a first head printing run to clear the first print head before energizing the solenoid to separate the printing cylinders, and further to clear the second head before its circuits are enabled to allow that head to shift to cylinder contact position upon sensing of a passing sheet. In the alternate printing situation the function of the circuits 400 and 402 is to allow the final copy of the printing run to clear the nip of the first print head before enabling its circuits to allow that head to shift to cylinder contact upon detecting a passing sheet, and to activate separation of the cylinders at the second print head, but only after the last sheet has cleared the nip and received its impression.

With regard to the operation in the duplex mode it will be noted that when switches 408 and 412 are shifted to the duplex contacts, circuits 400 and 408 are disabled and will not function, thereby permitting the cylinder separation operations proceed in conventional fashion.

In discussing the circuits, several simplex/duplex selection switches have been mentioned. It will be understood, of course, that preferably all of these switches (e.g., switches 312, 314, 330, 408 and 412) will be ganged together for operation by a single manual control element.

OPERATION

When the operator desired to conduct alternate simplexing operations he supplies the machine with copy paper and masters, sets all of the simplex/duplex switches to simplex position, sets the machine to bypass the turnover device 60 if not already in this condition, sets switch 332 to the position indicating the head upon which printing should first occur, e.g., the first head, sets the desired number of copies to be printed in the first printing run, and then turns on the machine to start operations.

The start-up contact R 71-1 will, through circuits 323 and 333 insure that relays R 41 and R 42 are toggled to the proper starting position and then will open when the first master is inserted on the first print head, remaining in this condition for the duration of the operation.

When the count-of-five counter sends its signal on conductor 324 (usually five revolutions before zero coincidence on the down counter) R 41 toggles and thereby triggers master preparation on the second head. At about this time the operator can reset the copy counter to the number of copies required on the second printing head, the copy counter being conventionally arranged to take new setting information while still completing the original count.

When R 41 toggles it also conditions circuits 400 and 402 for proper timing of cylinder transfer conditions, and when zero coincidence on the copy counter occurs these cylinder transfer operations go into effect by way of circuits 400 and 402. This zone coincidence also initiates end-of-cycle functions including blanket cleaning of the first head blanket by the blanket cleaning unit 54 and causes automatic resetting of the copy counter to the new count for the second print head.

Shortly thereafter feeding of copy sheets is automatically resumed, this time passing between the separated cylinders on the first print head without contact with the blanket being cleaned, and receiving a printing impression on the second print head. This printing operation continues until the count-of-five signal is again received on conductor 324 which again toggles the relay R 41, this time back to reference position.

With this toggling of R 41, the above-noted steps occur, this time terminating printing on the second print head and restoring it to the first print head while the second print head is undergoing end-of-cycle functions including blanket cleaning of the second head blanket by the blanket cleaning unit 56. At this time the operator makes a copy setting for the first print head, and the operation continues as above-described.

Alternation of the print heads in this way persists until the available masters are exhausted, and then the machine shuts down to idle condition in the conventional manner.

When the operator wishes to use the machine in its normal duplexing manner, he merely throws the simplex/duplex selector switches to the duplex contacts and proceeds to operate the machine in customary fashion.

The foregoing description is based on the current construction of the machine using relay logic control, and it can be seen that under these circumstances it is possible to provide substantial overlap between the printing process on one print head and the end-of-cycle and master preparation functions on the other print head with a resulting high degree of efficiency of use of the machine capabilities when operated in the simplex mode. In fact when the printing runs are of sufficient length, e.g., nineteen copies or longer, the overlap is nearly complete so as to make possible almost continuous printing in spite of shifting from one printing master to another as the work progresses.

It should be understood, however, that other control systems are contemplated, for example systems using combinational logic or microprocessor techniques which would make it possible for even more exact control in which there would be no wasted revolutions in any case where the printing runs equal or exceed the number of revolutions required for end-of-cycle and master preparation functions.

While the invention has been discussed in connection with machines which include the concept of providing special control of the master by feeding masters to both heads from a single source as in U.S. Pat. No. 3,987,722, it will be understood that the principles are equally applicable to other dual head tandem duplicators, in particular those more conventionally arranged with individual master supply arrangements for each print head.

In order to illustrate the simplexing operation more graphically, FIG. 13 has been provided showing the actions on the first print head on an upper line and those on the second print head on a lower line, both against a scale of cylinder revolutions at the top of the chart. Each operation shows the approximate number of revolutions required for its performance in the present machine, this number being given in parentheses after the legend designating the operation. The numbers are purely exemplary of course, and may change depending on various parameters of this equipment used.

As shown in FIG. 13, each time, during a printing run on a print head, that the count-of-five counter generates its count-of-five signal (which in this example occurs five revolutions before zero coincidence on the copy down counter 64), that signal terminates the end of cycle functions and initiates the master preparation, both with respect to the other or non-printing head. It will be recalled that when the copy down counter 64 counts down to zero coincidence during a run on one head, an end-of-cycle signal will initiate or activate the end-of-cycle functions for that head. Thus, the end-of-cycle functions for a given print head (including the blanket cleaning of that given print head blanket by the associated one of the blanket cleaning units 54 and 56) are initiated by a zero coincidence signal developed at the end of the printing run of that given print head and are terminated by the count-of-five signal occurring during the printing run of the other print head.

The number (19) appearing in connection with the feed of copy sheets was selected as being, in the present instance, the shortest length run which would take maximum advantage of the overlap condition (i.e., which would provide operation with a minimum number of non-printing cylinder revolutions) under the conditions of the equipment and control circuitry being used at the present time.

What is claimed is:

1. A rotary lithographic duplicator for printing copy paper sheets, said duplicator comprising:

a first print head including a blanket cylinder and an impression cylinder forming a first printing nip;

a second print head in tandem with said first print head and including a blanket cylinder and an impression cylinder forming a second printing nip;

means included in each impression cylinder of said first and second print heads for holding the lead margin of each copy sheet against the impression cylinder as the copy sheet passes between that impression cylinder and its associated blanket cylinder;

cylinder control means associated with each print head for causing printing engagement between the blanket cylinder and the impression cylinder or separation of the blanket cylinder and impression cylinder;

means for preparing each print head for operation including blanket cleaning means and master preparation means;

means for selectively activating said cylinder control means on each of the print heads to a condition maintaining the separated condition of the cylinders of the selected print head for the duration of a printing run on the other print head for the duration of a printing run on the other print head;

first and second guide means respectively associated with said first and second print heads, each of said guide means positioned adjacent the printing nip of the associated print head and being active when the blanket and impression cylinders of said associated print head are separated by the activation of the associated cylinder control means for keeping each sheet whose lead margin is being held by the associated holding means out of contact with the surface of the blanket cylinder of said associated print head, each guide means comprising a plate having a lip closely approaching the nip of the blanket and impression cylinders of the associated print head on the sheet approach side of the nip, said lip of said plate extending toward the surface of the associated impression cylinder so that, when the cylinders of said associated print head are separated while the other print head is printing, said plate causes each approaching sheet, whose lead margin is being held by the associated holding means to be channeled toward the surface of the associated impression cylinder; and control means for automatically alternately (1) actuating said print head preparing means and said selectively activating means with respect to the cylinders of one of said print heads, in combination with the actuation of a printing operation on the other print head, and (2) actuating said print head preparing means and said selectively activating means with respect to the cylinders of the said other print head, in combination with the actuation of a printing operation on the said one of said print heads.

2. A duplicator as set forth in claim 1 which includes a copy paper source positioned on the duplicator such that there is a difference in length between a first paper path between said copy paper source and said first print head and a second paper path between said copy paper source and said second print head, and in which the control means includes means for individually controlling said selectively activating means on said print heads individually at different times in order to accommodate the difference in length of paper path between the copy paper source and the respective print heads.

3. A duplicator as set forth in claim 1 wherein each holding means is a gripper which is configured with a thin lip portion for holding the lead margin of a copy sheet in contact with and substantially tangent to the impression cylinder surface.

4. A duplicator as set forth in claim 1 which includes a copy paper source positioned on the duplicator such that there is a difference in length between a first paper path between said copy paper source and said first print head and a second paper path between said copy paper source and said second print head, and in which:

the control means includes means for individually controlling said selectively activating means on said print heads individually at different times in order to accommodate the difference in length of paper path between the copy paper source and the respective print heads; and each holding means is a gripper which is configured with a thin lip portion for holding the lead margin of a copy sheet in contact with and substantially tangent to the impression cylinder surface.

5. A rotary lithographic duplicator for printing copy paper sheets, said duplicator comprising:

a first print head including a blanket cylinder and an impression cylinder forming a first printing nip;

a second print head in tandem with said first print head and including a blanket cylinder and an impression cylinder forming a second printing nip;

means included in each impression cylinder of said first and second print heads for holding the lead margin of each copy sheet against the impression cylinder as the copy sheet passes between that impression cylinder and its associated blanket cylinder;

cylinder control means associated with each print head for causing printing engagement between the blanket cylinder and the impression cylinder or separation of the blanket cylinder and impression cylinder;

means for preparing each print head for operation including blanket cleaning means and master preparation means;

means for selectively activating said cylinder control means on each of the print heads to a condition maintains the separated condition of the cylinders of the selected print head for the duration of a printing run on the other print head;

first and second guide means respectively associated with said first and second print heads, each of said guide means positioned adjacent the printing nip of the associated print head and being active when the blanket and impression cylinders of said associated print head are separated by the activation of the associated cylinder control means for keeping each sheet whose lead margin is being held by the associated holding means out of contact with the surface of the blanket cylinder of said associated print head, each guide means further including means for directing at least one jet of air towards the nip of the associated blanket and impression cylinders from the departure side of the nip so as to strike the departing sheet on the face turned towards the associated blanket cylinder and urge said departing sheet towards the associated impression cylinder; and control means for automatically alternately (1) actuating said print head preparing means and said selectively activating means with respect to the cylinders of one of said print heads, in combination with the actuation of a printing operation on the other print head, and (2) actuating said print head preparing means and said selectively activating means with respect to the cylinders of the said other print head, in combination with the actuation of a printing operation on the said one of said print heads.

6. A rotary lithographic duplicator for printing copy paper sheets, said duplicator comprising:

a first print head including a blanket cylinder and an impression cylinder forming a first printing nip;

a second print head in tandem with said first print head and including a blanket cylinder and an impression cylinder forming a second printing nip;

means included in each impression cylinder of said first and second print heads for holding the lead margin of each copy sheet against the impression cylinder as the copy sheet passes between that impression cylinder and its associated blanket cylinder, each holding means being a gripper which is configured with a thin lip portion for holding the lead margin of a copy sheet in contact with and substantially tangent to the impression surface;

cylinder control means associated with each print head for causing printing engagement between the blanket cylinder and the impression cylinder or separation of the blanket cylinder and impression cylinder;

means for preparing each print head for operation including blanket cleaning means and master preparation means;

means for selectively activating said cylinder control means on each of the print heads to a condition maintaining the separated condition of the cylinders of the selected print head for the duration of a printing run on the other print head;

first and second guide means respectively associated with said first and second print heads, each of said guide means positioned adjacent the printing nip of the associated print head and being active when the blanket and impression cylinders of said associated print head are separated by the activation of the associated cylinder control means for keeping each sheet whose lead margin is being held by the associated holding means out of contact with the surface of the blanket cylinder of said associated print head, each guide means comprising a plate having a lip closely approaching the nip of the blanket and impression cylinders of the associated print head on the sheet approach side of the nip, said plate being so angled toward the surface of the associated impression cylinder, that, when the cylinders of said associated print head are separated while the other print head is printing, said plate channels toward the surface of the associated impression cylinder each approaching sheet, whose lead margin is being held by the associated holding means, each guide means further including means for directing at least one jet of air towards the nip of the associated blanket and impression cylinders from the departure side of the nip so as to strike the departing sheet on the face turned towards the associated blanket cylinder and urge said departing sheet towards the associated impression cylinder;

control means for automatically alternately (1) actuating said print head preparing means and said selectively activating means with respect to the cylinders of one of said print heads, in combination with the actuation of a printing operation on the other print head, and (2) actuating said print head preparing means and said selectively activating means with respect to the cylinders of the said other print head, in combination with the actuation of a printing operation on the said one of said print heads; and a copy of paper source positioned on the duplicator such that there is a difference in length between a first paper path between said copy paper source and said first print head and a second paper path between said copy paper source and said second print head, said control means including means for individually controlling said selectively activating means on said print heads individually at different times in order to accommodate the difference in length of paper path between the copy paper source and the respective print heads.

* * * * *